US009913318B2

(12) United States Patent
Gasworth

(10) Patent No.: US 9,913,318 B2
(45) Date of Patent: Mar. 6, 2018

(54) METHOD AND DEVICE FOR HEATING A SURFACE

(71) Applicant: SABIC GLOBAL TECHNOLOGIES B.V., Bergen op Zoom (NL)

(72) Inventor: Steven Marc Gasworth, Wixcom, MI (US)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 15/518,273

(22) PCT Filed: Nov. 25, 2015

(86) PCT No.: PCT/IB2015/059108
§ 371 (c)(1),
(2) Date: Apr. 11, 2017

(87) PCT Pub. No.: WO2016/084008
PCT Pub. Date: Jun. 2, 2016

(65) Prior Publication Data

US 2017/0311385 A1 Oct. 26, 2017

Related U.S. Application Data

(60) Provisional application No. 62/084,071, filed on Nov. 25, 2014.

(51) Int. Cl.
*H05B 1/00* (2006.01)
*H05B 3/00* (2006.01)
*H05B 3/20* (2006.01)

(52) U.S. Cl.
CPC ..... *H05B 3/0033* (2013.01); *H05B 3/20* (2013.01); *H05B 2203/032* (2013.01); *H05B 2214/02* (2013.01)

(58) Field of Classification Search
CPC .. H05B 3/0033; H05B 3/20; H05B 2203/032; H05B 2214/02; H01L 31/055;
(Continued)

(56) References Cited

U.S. PATENT DOCUMENTS 2,515,584 A 7/1950 Benson
2,795,069 A 6/1957 Hardesty
(Continued)

FOREIGN PATENT DOCUMENTS

DE 10110142 B4 6/2005
EP 0334799 A2 9/1989
(Continued)

OTHER PUBLICATIONS

Althues et al.; "Functional inorganic nanofillers for transparent polymers"; Chemical Society Reviews; (2007); 36; pp. 1454-1465.
(Continued)

*Primary Examiner* — Shawntina Fuqua
(74) *Attorney, Agent, or Firm* — Cantor Colburn LLP

(57) ABSTRACT

In an embodiment, a heating device comprises a radiation source that emits a source radiation, a radiation emitting layer comprising an emitting layer host material and a luminescent agent, wherein the radiation emitting layer comprises an edge, an emitting layer first surface, and an emitting layer second surface; wherein the radiation source is coupled to the edge, wherein the source radiation is transmitted from the radiation source through the edge and excites the luminescent agent, whereafter the luminescent agent emits an emitted radiation, wherein at least a portion of the emitted radiation exits through the emitting layer second surface through an escape cone; an absorber layer, wherein the absorber layer comprises an absorber layer first surface and wherein the absorber layer first surface is in direct contact with the emitting layer second surface,
(Continued)

wherein the absorber layer comprises an absorber that absorbs emitted radiation that escapes through the escape cone.

20 Claims, 2 Drawing Sheets

(58) Field of Classification Search
CPC ..... H01L 31/0547; H01L 31/0232; H01L 31/0525; H01L 31/0543; Y02E 10/52; G02B 5/09; G02B 6/00; G02B 19/0042; G02B 19/0019; G02B 27/148
See application file for complete search history.

(56) References Cited

U.S. PATENT DOCUMENTS

| | | | |
|---|---|---|---|
| 2,886,911 | A | 5/1959 | Hardesty |
| 3,506,325 | A | 4/1970 | Horvay |
| 3,962,702 | A | 6/1976 | Kriege |
| 4,768,256 | A | 9/1988 | Motoda |
| 4,792,536 | A | 12/1988 | Pecoraro et al. |
| 5,165,187 | A | 11/1992 | Shahidi-Hamedani et al. |
| 5,408,572 | A | 4/1995 | Kriege |
| 5,618,863 | A | 4/1997 | D'Errico et al. |
| 5,712,332 | A | 1/1998 | Kaieda et al. |
| 5,750,267 | A | 5/1998 | Takase et al. |
| 5,756,192 | A | 5/1998 | Crawley et al. |
| 5,766,739 | A | 6/1998 | Funaki et al. |
| 5,816,238 | A | 10/1998 | Burns et al. |
| 5,951,920 | A | 9/1999 | Schuman et al. |
| 6,051,194 | A | 4/2000 | Peill et al. |
| 6,139,803 | A | 10/2000 | Watanabe et al. |
| 6,205,282 | B1 | 3/2001 | Gaydoul |
| 6,272,265 | B1 | 8/2001 | Franklin |
| 6,285,816 | B1 | 9/2001 | Anderson et al. |
| 6,319,613 | B1 | 11/2001 | Takeda et al. |
| 6,404,543 | B1 | 6/2002 | Shoshi et al. |
| 6,911,254 | B2 | 6/2005 | Fisher et al. |
| 7,052,161 | B2 | 5/2006 | Lichtenstein et al. |
| 7,194,158 | B2 | 3/2007 | Schultheis et al. |
| 7,238,418 | B2 | 7/2007 | Fujita |
| 7,258,923 | B2 | 8/2007 | Van Den Bogerd et al. |
| 7,338,180 | B2 | 3/2008 | Wing |
| 7,434,951 | B2 | 10/2008 | Bienick |
| 7,572,486 | B2 | 8/2009 | Takahashi et al. |
| 7,612,727 | B2 | 11/2009 | Schwenke |
| 7,764,421 | B2 | 7/2010 | Fujiwara et al. |
| 8,105,472 | B2 | 1/2012 | Garbar et al. |
| 8,236,383 | B2 | 8/2012 | Gasworth et al. |
| 8,292,458 | B2 | 10/2012 | Bertram et al. |
| 9,001,288 | B2 | 4/2015 | Tsukara et al. |
| 2003/0022967 | A1 | 1/2003 | Dobler et al. |
| 2004/0028920 | A1 | 2/2004 | Fujita et al. |
| 2004/0131845 | A1 | 7/2004 | Fujita |
| 2004/0191485 | A1 | 9/2004 | Groothues |
| 2005/0095433 | A1 | 5/2005 | Bogerd et al. |
| 2006/0001036 | A1 | 1/2006 | Jacob et al. |
| 2006/0209551 | A1 | 9/2006 | Schwenke et al. |
| 2007/0048519 | A1 | 3/2007 | Anderson et al. |
| 2008/0050579 | A1 | 2/2008 | Kirkman et al. |
| 2008/0265789 | A1 | 10/2008 | Bertram et al. |
| 2010/0068532 | A1 | 3/2010 | Fisher |
| 2013/0298419 | A1 | 11/2013 | Trevett et al. |
| 2014/0119052 | A1 | 5/2014 | Hayama |
| 2014/0153215 | A1 | 6/2014 | Hayama |

FOREIGN PATENT DOCUMENTS

| | | | |
|---|---|---|---|
| EP | 0579835 | A1 | 5/1993 |
| EP | 0732049 | B1 | 5/1998 |
| FR | 960125 | | 10/1949 |
| GB | 2333829 | A | 8/1999 |
| JP | S5911934 | A | 1/1984 |
| JP | 62195882 | A | 8/1987 |
| JP | H03227366 | A | 10/1991 |
| JP | H11321304 | A | 11/1999 |
| JP | 2000096034 | | 4/2000 |
| JP | 2000178428 | | 6/2000 |
| JP | 2002138271 | | 5/2002 |
| JP | 2002194291 | | 7/2002 |
| JP | 2003105186 | | 4/2003 |
| JP | 2003201155 | | 7/2003 |
| JP | 2004355961 | | 12/2004 |
| JP | 2005047179 | | 2/2005 |
| JP | 2005337698 | A | 12/2005 |
| JP | 2013001611 | A | 1/2013 |
| WO | 2004037620 | A1 | 5/2004 |
| WO | 2004044481 | A1 | 5/2004 |
| WO | 2005003047 | A1 | 1/2005 |
| WO | 2006088370 | A2 | 8/2006 |
| WO | 2016084009 | A1 | 6/2016 |

OTHER PUBLICATIONS

Binnemans; "Lanthanide-Based Luminescent Hybrid Materials"; Chem. Rev. (2009); 109; pp. 4283-4374.

Earp et a.; "Maximising the light output of a Luminescent Solar Concentrator"; Solar Energy 76 (2004) pp. 655-667.

Fischer et al.; "Asymmetric PPCys: Strongly fluorescing NIR labels"; Chem. Commun.; (2010); 46; pp. 5289-5291.

Fischer et al.; "Near-Infrared Dyes and Fluorophores Based on Diketopyrrolopyrroles"; Angew. Chem. Int. Ed.; (2007); 46; pp. 3750-3753.

Fischer et al.; "Pyrrolopyrrol Cyanine (PPCy) dyes: A new class of near-infrared dyes and fluorophores"; Chemistry A European Journal; Supporting Information; (2009); 15 pages.

Fischer et al.; "Pyrrolopyrrole Cyanine Dyes: A New Class of Near-Infrared Dyes and Fluorophores"; Chem. Eur. J.; (2009); 15; pp. 4857-4864.

Fischer et al.; "Selective NIR chromophores: Bis(Pyrrolopyrrole) Cyanines"; Angew. Chem. Int. Ed.; (2011); 50; pp. 1406-1409.

Fischer et al.; "Selective NIR chromophores: Bis(Pyrrolopyrrole) Cyanines"; Angewandte Chemi; Supporting Information (2011); 26 pages.

Gnaser et al.; "Nanocrystalline TiO2 for Photocatalysis"; Encyclopedia of Nanoscience and Nanotechnology; vol. 6 (2004); pp. 505-535.

Groh et al.; "What is the Lowest Refractive Index of an Organix Polymer?"; Macromolecules (1991); 24; pp. 6660-6663.

Hale et al.; "Optical Constants of Water in the 200-nm to 200-um Wavelength Region"; Applied Optics; vol. 12; No. 3; (Mar. 1973); pp. 555-563.

Hofstadler et al.; "New Reacotr Design for Photocatalytic Wastewater Treatment with TiO2 Immobilized on Fused-Silica glass Fibers: Photomineralization of 4-Chlorophenol"; Environ. Sci. Technol. (1994); 28; pp. 670-674.

International Search Report for International Application No. PCT/IB2015/059108;International Filing Date Nov. 25, 2015; dated Feb. 15, 2016; 5 pages.

Kalyani et al.; "Organic light emitting diodes: Energy saving lighting technology—A review"; Renewable and Sustainable Energy Review 16; (2012); pp. 2696-2723.

Koole et al.; "On the Incorporation Mechanism of Hydrophobic Quantum Dots in Silica Spheres by a Reverse Microemulsion Method"; Chem. Mater. (2008) 20; pp. 2503-2512.

Liou et al.; "Flexible Nanocrystalline-Titania/Polyimide Hybrids with High Refractive Index and Excellent Thermal Dimensional Stability"; J. Polymer Science: Part A: Polymer Chemistry; vol. 48; pp. 1433-1441; (2010).

Liu et al.; "High refractive index polymers: fundamental research and practical applications"; J. Materials Chemistry; (2009); 19; pp. 8907-8919.

Mayerhoffer et al.; "Synthesis and Molecular Properties of Acceptor-Substituted Squaraine Dyes"; Chem. Eur. J.; (2013); 19; pp. 218-232.

Melby et al.; "Synthesis and Fluorescence of Trivalent Lanthanide Complexes"; J. Amer. Chem. Soc.; 86; (1964); pp. 5117-5125.

(56) References Cited

OTHER PUBLICATIONS

Mills et al.; "A web-based overview of semiconductor photochemistry-based current commercial applications"; Journal of Photochemistry and Photobiology A: Chemistry 152 (2002); pp. 233-247.
Mills et al.; "Simultaneous monitoring of the destruction of stearic acid and generation of carbon dioxide by self-cleaning semiconductor photocatalytic films"; Jrnl. of Photochemistry and Photobiology A: Chemistry 182 (2006); pp. 181-186.
Nakane et al.; "Properties of poly(vinyl butyral)/TiO2 nanocomposites formed by sol-gel process"; Composites Part B 35; (2004); pp. 219-222.
Olson et al.; "Luminescent solar concentrators and the reabsorption problem"; Applied Optics; vol. 20; No. 17 (Sep. 1981); pp. 2934-2940.
Palladino; "Supercar company McLaren wants to do away with old-school windshield wipers for good"; http://www.theverge.com/2013/12/17/5220842/mclaren-windshield-wiper-technology; Dec. 17, 2013; 18 pages.
Peill et al.; "Chemical and Physical Characterization of a TiO2-Coated Fiber Optic Cable Reactor"; Environ. Sci. Technol. 30 (1996); pp. 2806-2812.
Roberts et al.; "Efficient excitation energy transfer among multiple dyes in polystyrene microspheres"; Journal of Luminescence 79 (1998) pp. 225-231.
Romanelli et al.; "Intense Near-IR Emissin from Nanoscale Lanthanoid Fluoride clusters"; Angew. Chem. Int. Ed.; (2008); 47; pp. 6049-6051.
Sun et al.; "TiO2-coated optical fiber bundles used as a photocatalytic filter for decomposition of gaseous organic compounds"; Journal of Photochemistry and Photobiology A: Chemistry 136 (2000); pp. 111-116.
Wang et al.; "Europium complex doped luminescent solar concentrators with extended absorption range from UV to visible region"; Solar Energy 85; (2011); pp. 2179-2184.
Wang et al.; "Large-Scale Solvent-Free Chlorination of Hydroxy-Pyrimidines, -Pyridines, -Pyrazines and -Amides Using Equimolar POCl3"; Molecules 2012; 17; pp. 4533-4544.
Wang et al.; "Recent advances in the chemistry of lanthanide-doped upconversion nanocrystals"; Chem. Soc. Rev.; (2009); 38; pp. 976-989.
Warren et al.; "Optical constants of ice from the ultraviolet to the microwave: A revised compilation"; Journal of Geophysical Research; vol. 113; D14220; (2008); 10 pages.
Wenger et al.; "Chemical Tuning of the Photon Upconversion Properties in Ti2+-Doped Chloride Host Lattices"; Inorg. Chem. (2001); 40; pp. 5747-5753.
Wiktorowski et al.; "Photophysics of aminophenyl substituted pyrrolopyrrole cyanines"; Phys. Chem. Chem. Phys.; (2012); 14; pp. 2921-2928.
Written Opinion of the International Search Report for International Application No. PCT/IB2015/059108;International Filing Date Nov. 25, 2015; dated Feb. 15, 2016; 5 pages.
Xu et al.; "Photocatalytic activity on TiO2-coated side-glowing optical fiber reactor under solar light"; J. Photochemistry and Photobiology A: Chemistry 199 (2008); pp. 165-169.
You et al.; "Synthesis of Highly Refractive and Transparent Polyimides Derived from 4,4'-Thiobis[2",6"-dimethyl-4"-(p-phenylenesulfanyl)aniline]"; J. Polymer Science Part A: Polymer Chemistry; vol. 48; pp. 656-662 (2010).
Yuwono et al.; "Controlling the crystallinity and nonlinear optical properties of transparent TiO2-PMMA nanohybrids"; J. Materials Chemistry; (2004); 14; pp. 2978-2987.
Zimmermann et al.; "Polymer Nanocomposites with "Ultralow" Refractive Index"; Polymers for Advanced Technologies; vol. 4; pp. 1-7; 1993.
Nieman et al, "An Apertureless Near-field Scanning Optical Microscope and its Application to Surface-enhanced Raman Spectroscopy and Multiphoton Fluorescence Imaging", Review of Scientific Instruments, 2001, pp. 1691-1699, vol. 72, Third Edition.

METHOD AND DEVICE FOR HEATING A SURFACE

CROSSS REFERENCE TO RELATED APPLICATIONS

This application is a National Stage application of PCT/IB2015/059108, filed Nov. 25, 2015, which claims the benefit of U.S. Provisional Application No. 62/084,071, filed Nov. 25, 2014, both of which are incorporated by reference in their entirety herein.

BACKGROUND

Heating devices have been developed for applications such as defrosting, defogging, and/or deicing a surface. These devices suffer from one or more of an obstructed view through the device, opacity, insufficiently uniform heating, insufficient heating far from the edge of the device, and low efficiency. A heating device that is able to overcome one or more of these drawbacks is desirable.

BRIEF DESCRIPTION

Disclosed herein is a device and method for heating a surface.

In an embodiment, a heating device comprises a radiation source that emits a source radiation, a radiation emitting layer comprising an emitting layer host material and a luminescent agent, wherein the radiation emitting layer comprises an edge, an emitting layer first surface, and an emitting layer second surface; wherein the edge has a height of $d_L$ and the emitting layer first surface has a length L, wherein length L is greater than height $d_L$, and the ratio of the length L to the height $d_L$ is greater than or equal to 10; wherein the radiation source is coupled to the edge, wherein the source radiation is transmitted from the radiation source through the edge and excites the luminescent agent, whereafter the luminescent agent emits an emitted radiation, wherein at least a portion of the emitted radiation exits through the emitting layer second surface through an escape cone; an absorber layer, wherein the absorber layer comprises an absorber layer first surface and wherein the absorber layer first surface is in direct contact with the emitting layer second surface, wherein the absorber layer comprises an absorber that absorbs emitted radiation that exits the radiation emitting layer through the emitting layer second surface.

In another embodiment, a method for heating a surface comprises emitting a source radiation from a radiation source; illuminating a radiation emitting layer comprising an emitting layer host material and a luminescent agent with the radiation, wherein the radiation emitting layer comprises an edge, an emitting layer first surface, and an emitting layer second surface; wherein the radiation source is coupled to the edge, wherein the source radiation is transmitted from the radiation source through the edge and excites the luminescent agent, whereafter the luminescent agent emits an emitted radiation, wherein at least a portion of the emitted radiation exits through the emitting layer second surface through an escape cone; absorbing the emitted radiation by an absorber in an absorber layer that comprises an absorber layer first surface and an absorber layer second surface and wherein the absorber layer first surface is in direct contact with the emitting layer second surface; and heating the absorber layer second surface.

The above described and other features are exemplified by the following figures and detailed description.

BRIEF DESCRIPTION OF THE DRAWINGS

Refer now to the figures, which are exemplary embodiments, and wherein the like elements are numbered alike.

DETAILED DESCRIPTION

Figure 1:
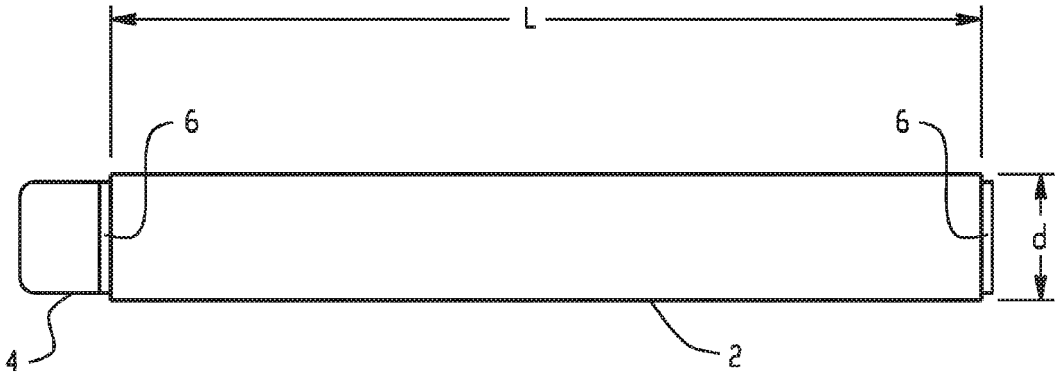
FIG. 1 is a cross-sectional side view of a heating device comprising a layered structure.

Heating devices, for example, window defrosters in automobiles, have been developed such that parallel, electrically conductive traces or coatings span the length of the window to be defrosted. These traces or coatings can lead to uneven defrosting and can reduce visibility through the window, and they can be difficult to apply to complex shapes. Further heating devices have been developed such that a light source emits radiation to the heating device that comprises an absorber, where the absorber absorbs the light and produces heat. As the light source is often disposed at an end of the heating device, problems arise with absorption decay with distance from the light source such that these devices provide insufficiently uniform heating of a surface or insufficient heating far from the edge of the device.

In order to overcome these and other drawbacks, the Applicants developed a heating device comprising a radiation source and a radiation emitting layer comprising a host and a luminescent agent, wherein the radiation source is coupled to an edge of the radiation emitting layer. The radiation emitting layer can uniformly emit radiation over the length of the device. As used herein, uniform radiation emission refers to the measured radiation at all locations on a broad surface, for example, one or both of the emitting layer first surface and the emitting layer second surface, of the radiation emitting layer being within 40%, specifically, 30%, more specifically, 20% of the average radiation being emitted from the broad surface. An absorber layer comprising an absorber layer first surface can be in direct contact with an emitting layer second surface. The absorber layer comprises an absorber. The absorber can comprise a radiationless absorber with an absorption spectrum that overlaps with the emission spectrum of the luminescent agent. By locating the luminescent agent and the absorber in separate layers, the absorber is prevented from competing with the luminescent agent for the light emitted by the source allowing for the radiation emitting layer to uniformly emit radiation over the length of the layer. The uniformly emitted radiation can then be absorbed by the absorber in the absorber layer, where the absorber layer can correspondingly be heated uniformly. As used herein, uniform heating refers to the measured heating at all locations on a broad surface, for example, an absorber layer second surface, of the absorber layer being within 40%, specifically, 30%, more specifically, 20% of the average heating at the broad surface.

The heating device is able to achieve one or more of the following: 1) uniform radiation emission over one or both of the broad surfaces of the radiation emitting layer without requiring, for example, gradients in the active agents; 2) a preheated surface to pre-empt the formation of fog and/or ice on a broad surface of the heating device; 3) the radiation can be emitted from both of the broad surfaces of the radiation emitting layer; and 4) a uniform heating of the absorber layer. The heating device can provide sufficient heat to melt a 1 mm thick layer of ice located on at least one of the broad surfaces of the radiation emitting layer in less than or equal to 1 hour.

Figure 3:
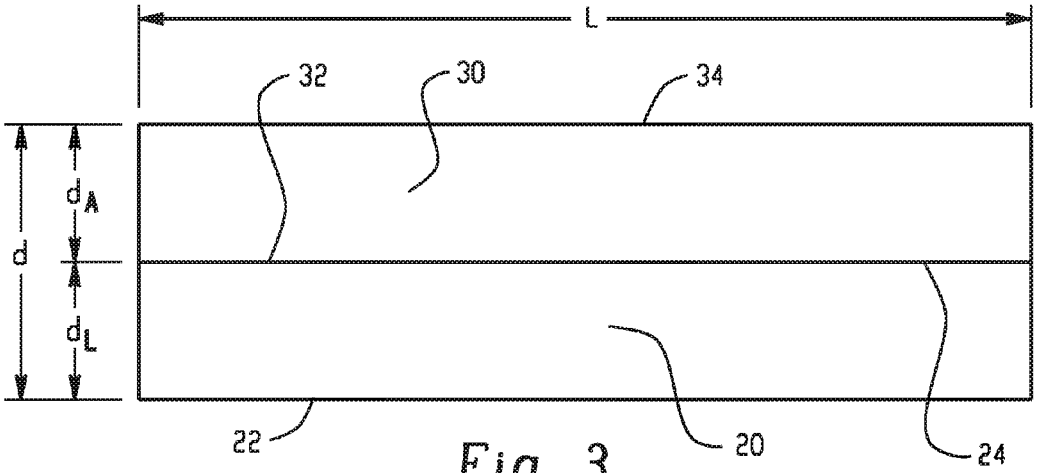
FIG. 3 is a cross-sectional side view of a layered structure.

The heating device comprises a layered structure that comprises a radiation emitting layer and an absorber layer. As illustrated in FIG. 3, the layered structure can have a length L that is bounded by edges with a height d, where the height d is the height of the heating device. The ratio of L to d can be greater than or equal to 10, specifically, greater than or equal to 30, more specifically, 30 to 10,000, and still more specifically, 30 to 500. The ratio of L to $d_L$, where $d_L$ is the height of the emitting layer, can be greater than or equal to 10, specifically, greater than or equal to 30, more specifically, 30 to 10,000, and still more specifically, 30 to 500.

The layered structure can be flat, for example, if the device will be used as a shelf, or curved, for example, if the device will be used as a lens. The distance between a first surface and a second surface of a layer in the device can be constant or can vary at different locations in the device.

Referring to the figures, FIG. 1 illustrates a cross-sectional view of a heating device, where the heating device comprises layered structure 2 that comprises a radiation emitting layer and an absorber layer. Layered structure 2 has two broad, coextensive outer surfaces of length L that are bounded by short edges with height d. Radiation source 4 is an edge coupled radiation source that emits radiation to an edge of layered structure 2. Edge mirrors 6 can reduce the amount of radiation loss through the edges. The edge mirror located proximal to radiation source 4 can be a selectively reflecting mirror. It is noted that while radiation source 4 and edge mirrors 6 are illustrated as spanning the height d of the heating device, they could independently be edge coupled to only the height of the radiation emitting layer of the layered structure.

Figure 4:
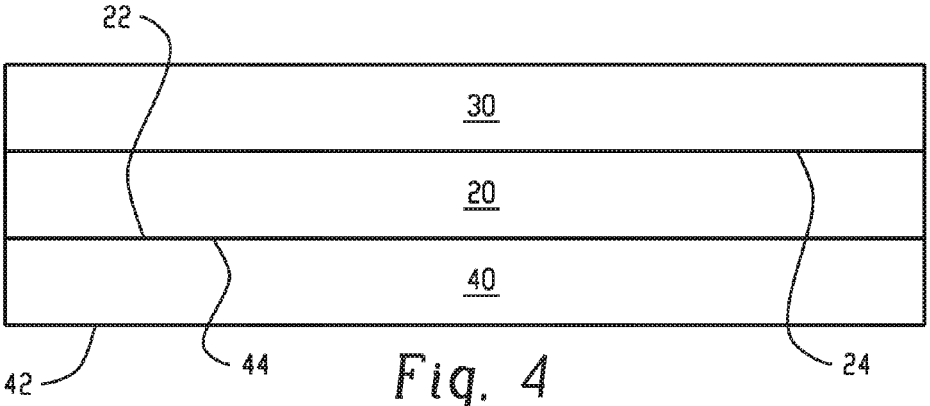
FIG. 4 is a cross-sectional side view of a layered structure.
Figure 5:
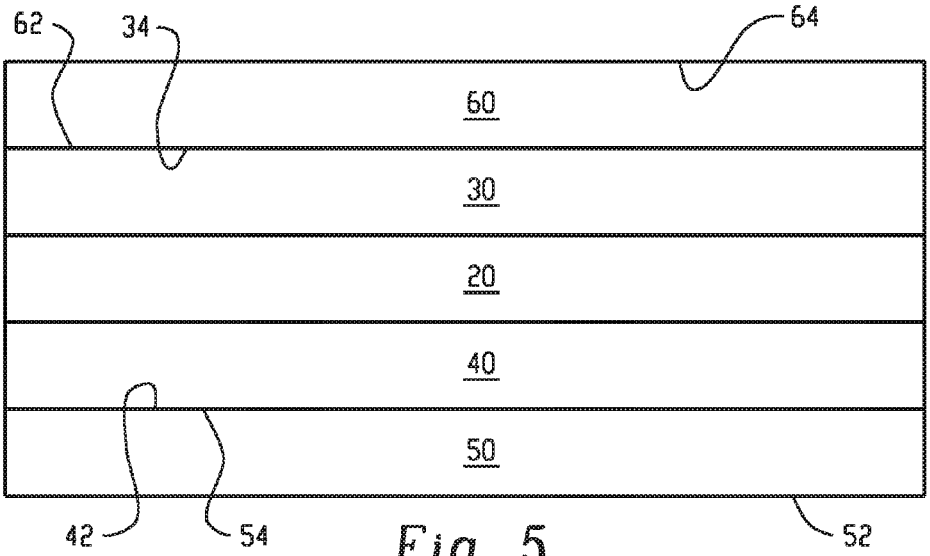
FIG. 5 is a cross-sectional side view of a layered structure.

FIGS. 3-5 illustrate cross-sectional views of the layered structure. FIG. 3 is an illustration of a layered structure comprising radiation emitting layer 20 that has emitting layer first surface 22 and emitting layer second surface 24 and absorber layer 30 that has absorber layer first surface 32 and absorber layer second surface 34, where emitting layer second surface 24 is in direct contact with absorber layer first surface 32. The height d of the layered structure is equal to the summation of the heights of the individual layers within the structure. For example, in the layered structure of FIG. 3, height d is equal to height $d_A$ of absorber layer 30 and height $d_L$ of radiation emitting layer 20 and the height d in FIG. 5 is equal to the summation of the heights of layers 20, 30, 40, 50, and 60.

FIG. 4 is an illustration of a layered structure comprising radiation emitting layer 20 that has emitting layer first surface 22 and emitting layer second surface 24, absorber layer 30, and third layer 40 that has third layer first surface 42 and third layer second surface 44, where third layer second surface 44 is in direct contact with emitting layer first surface 22. The third layer can be a second absorber layer. The third layer can be a protective coating layer.

FIG. 5 is an illustration of a layered structure comprising radiation emitting layer 20, absorber layer 30 that has absorber layer second surface 34, third layer 40 that has third layer first surface 42, fourth layer 50 that has fourth layer first surface 52 and fourth layer second surface 54, and fifth layer 60 that has fifth layer first surface 62 and fifth layer second surface 64. FIG. 5 illustrates that absorber layer second surface 34 is in direct contact with fifth layer first surface 62 and third layer first surface 42 is in direct contact with fourth layer second surface 54. Third layer 40 can be an absorber layer and fourth layer 50 and fifth layer 60 can be protective coating layers.

It is noted that while FIG. 5 illustrates a layered structure comprising third layer 40, fourth layer 50, and fifth layer 60, one or more of these layers may or may not be present. For example, a layered structure can comprise fifth layer 60 that is a protective coating layer, absorber layer 30, radiation emitting layer 20, and fourth layer 50 that is a protective coating layer. Likewise, a layered structure can comprise absorber layer 30, radiation emitting layer 20, third layer 40 that is an absorber layer, and fourth layer 50 that is a protective coating layer.

The heating device can further comprise a glass layer. A glass layer can be located on one or both sides of the emitting layer. A glass layer can be located on one or both sides of the absorber layer. A glass layer can be located on one or both of an outer surface of the layered structure.

The layered structure comprises a radiation emitting layer that comprises an emitting layer host material, a luminescent agent, and can further comprise a UV absorber. The luminescent agent can be dispersed throughout the emitting layer host material or can be localized to one or more sub-layers in the radiation emitting layer. For example, the radiation emitting layer can comprise a first radiation emitting sub-layer and a second radiation emitting sub-layer, wherein each of the radiation emitting sub-layers independently can comprise a luminescent agent. Likewise, the sub-layers can comprise the same or different luminescent agent and can comprise the same or different host material. When the radiation emitting layer comprises two or more sub-layers and one of the sub-layers is an in-mold coating, one or more of the luminescent agent can be located in said in-mold coating and can allow for more mild processing conditions for the luminescent agent. In other words, the radiation emitting layer can be an in-mold coating layer.

The surfaces of the radiation emitting layer can be smooth surfaces such that they support light guiding by total internal reflection Likewise, one or both surfaces can be textured, for example, for beam diffusion in lighting applications, where the texturing can act selectively on visible wavelengths while sustaining total internal reflection for longer wavelengths through the device.

The radiation emitting layer can be transparent such that the material has a transmittance of greater than or equal to 80%. The radiation emitting layer can be transparent such that the material has a transmittance of greater than or equal to 90%. The radiation emitting layer can be transparent such that the material has a transmittance of greater than or equal to 95%. Transparency can be determined by using 3.2 mm thick samples using ASTM D1003-00, Procedure B using CIE standard illuminant C, with unidirectional viewing.

The host material can comprise a material such as a polycarbonate (such as a bisphenol A polycarbonate), a polyester (such as poly(ethylene terephthalate) and poly (butyl terephthalate)), a polyarylate, a phenoxy resin, a polyamide, a polysiloxane (such as poly(dimethyl siloxane)), a polyacrylic (such as a polyalkylmethacylate (e.g., poly(methyl methacrylate)) and polymethacrylate), a polyimide, a vinyl polymer, an ethylene-vinyl acetate copolymer, a vinyl chloride-vinyl acetate copolymer, a polyurethane, or copolymers and/or blends comprising one or more of the foregoing. The host material can comprise polyvinyl chloride, polyethylene, polypropylene, polyvinyl alcohol, poly vinyl acrylate, poly vinyl methacrylate, polyvinylidene chloride, polyacrylonitrile, polybutadiene, polystyrene, polyvinyl butyral, polyvinyl formal, or copolymers and/or blends comprising one or more of the foregoing. The host material can comprise polyvinyl butyral, polyimide, polycarbonate, or a combination comprising one or more of the foregoing. When the radiation emitting layer comprises polycarbonate, the polycarbonate can comprise an IR absorbing polycarbonate. The host material can comprise one or more of the foregoing.

The radiation emitting layer comprises a luminescent agent, where the luminescent agent can comprise greater than or equal to 1 luminescent agent. The luminescent agent can comprise greater than or equal to 2 luminescent agents. The luminescent agent can comprise 2 to 6 luminescent agents. The luminescent agent can comprise 2 to 4 luminescent agents. The luminescent agent can comprise a single luminescent agent.

Luminescent agents have been used in luminescent solar concentrators (LSC), for example, in solar panels that function to absorb light from the sun. In an LSC, light is transmitted into the device through a broad surface of the device, where it is absorbed by a luminescent agent and is emitted at a different wavelength. A portion of the emitted light is transmitted by total internal reflection to an edge of the device where it is transmitted to an edge-coupled element such as a photovoltaic cell. For LSCs, a maximum collection of incident solar radiation is promoted by the following condition on the absorption coefficient at excitation wavelengths of the luminescent agent, $A_{ex/LSC}$:

$$A_{ex/LSC}>1/D \quad (1)$$

where D is the thickness of the device. Reabsorption during light transport along the LSC to the edge-coupled element is minimized by the following condition on the absorption coefficient at emission wavelengths of the luminescent agent, $A_{em/LSC}$:

$$A_{em/LSC}<<1/m \quad (2)$$

where m is the length of the device.

Figure 2:
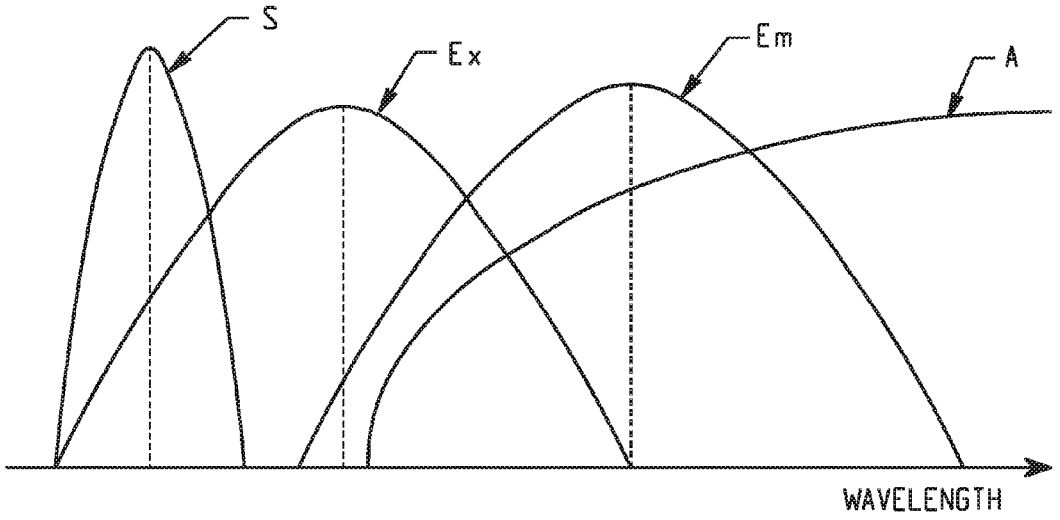
FIG. 2 is a graphical representation of excitation and emission spectra for a luminescent agent, a source spectrum, and an absorber spectrum.

In contrast, in the present heating device, reabsorption by the luminescent agent in the escape cone is largely avoided with the following condition on the concentration-dependent absorption coefficient at the emission wavelengths of a luminescent agent, $A_{em}$:

$$A_{em}\leq 1/d_L \quad (3)$$

where $d_L$ is the thickness of the radiation emitting layer (see FIG. 1). FIG. 2 illustrates that source spectrum S can overlap with excitation spectrum Ex of a downshifting luminescent agent. Distribution of source light over the length of the device is promoted by the following condition on the concentration-dependent absorption coefficient at the excitation wavelengths of the luminescent agent, $A_{ex}$:

$$A_{ex}\sim 1/L;\ 0.2/L\leq A_{ex}\leq 5/L \quad (4)$$

where L is the length of the device measured from the edge-coupled source, where if a second edge-coupled source were disposed on an edge opposite the first source then L would be replaced by L/2 in Equation 4. It is noted that if a second luminescent agent is present, for example, whose excitation spectrum does not overlap with the source spectrum S, it would not be subject to Equation 4 and can be present in relatively high effective concentration and can thus more effectively recycle photons in the long wavelength tail of the emission spectrum of the first luminescent agent.

FIG. 2 shows the excitation and emission spectrum of a radiation emitting layer comprising a luminescent agent LA. LA is a downshifting luminescent agent, where emission spectrum Em is shifted to longer wavelengths, where absorbed photons are converted to lower energy photons. It is understood that while FIG. 2 illustrates a downshifting luminescent agent, the radiation emitting layer can comprise an upshifting luminescent agent, where the emission spectrum is shifted to shorter wavelengths. It is further understood that upshifting encompasses up-conversion, whereby absorption of two photons at lower energy yields emission of one photon at higher energy. Source spectrum S overlaps with excitation spectrum Ex of the luminescent agent LA. This overlap results in the production of a first generation of photons with wavelengths represented by emission spectrum Em of the luminescent agent LA that occurs over the length of the device owing to Equation 4. A portion of those photons, for example, 20 to 30% can be emitted into the escape cone and will exit the radiation emitting layer through at least the emitting layer second surface, owing to Equation 3. The remaining photons that were not emitted within the escape cone can be guided by total internal reflection within the radiation emitting layer, where those reaching an edge can be reflected back into the radiation emitting layer, for example, by an edge mirror. These remaining photons can then encounter a luminescent agent. As the emission spectrum Em overlaps with excitation spectrum Ex the luminescent agent can be excited producing a second generation of photons with wavelengths as illustrated by emission spectrum Em. This second generation of emitted photons further contributes to photon emission from a surface of the radiation emitting layer through the escape cone, with the balance of the photons being recycled as with the first generation. Accordingly, further generations of photons are likewise produced.

It is understood that in FIG. 2, while the peaks are illustrated to be slightly offset from each other, they can be further offset from each other or can coincide with each other. It is likewise understood, that while not illustrated, the source, excitation and emission spectra can have tails that extend further along the x-axis below the illustrated base line.

The emitted radiation with an emission spectrum Em exits the radiation emitting layer and enters the absorber layer. As the emission spectrum Em overlaps with the absorption spectrum A of the absorber, the absorber can absorb the emitted radiation and can produce heat to heat the heating device.

One skilled in the art can readily envision a source spectrum based on the desired application. For example, the source can be chosen based on a desire to either avoid long wavelength host absorption bands or to avoid visible bands.

Regarding the LSC devices described above, Equations 3 and 4 differ significantly from Equations 1 and 2, further illustrating the novelty of the present heating device. Recognizing that 1/D>>1/m, and assuming respective ranges of D and m common to an LSC are similar to d and L of the present radiation emitting layer, Equations 1 and 4 indicate that $A_{ex}$ can be much lower than $A_{ex/LSC}$, so the optimum concentrations of the luminescent agent can be lower for the present device than for an LSC. Lower concentrations support avoidance of luminescent agent aggregation that can scatter light, which can reduce transparency, and/or quench luminescence, which can undermine efficiency.

The luminescent agent can be distributed over the length of the radiation emitting layer and can act, not only to shift the photon wavelength, but also to redirect photons. For example, a portion of the first generation photons can be redirected from total internal reflection within the radiation emitting layer into the escape cone so that they can exit the radiation emitting layer and a portion of the first generation photons can excite a further luminescent agent (such as one or both of the first luminescent agent and, if present, a further luminescent agent different from the first luminescent agent) within the radiation emitting layer.

The luminescent agent can be sized such that it does not reduce the transparency of the radiation emitting layer, for example, the luminescent agent can be one that does not scatter visible light, specifically, light with a wavelength of 390 to 700 nanometers (nm). The luminescent agent can have a longest average dimension of less than or equal to 300 nm, specifically, less than or equal to 100 nm, more specifically, less than or equal to 40 nm, still more specifically, less than or equal to 35 nm.

The luminescent agent can comprise a downshifting agent (such as $(py)_{24}Nd_{28}F_{68}(SePh)_{16}$, where py is pyridine), an upshifting agent (such as $NaCl:Ti^{2+}$; $MgCl_2:Ti^{2+}$; $Cs_2ZrBr_6:Os^{4+}$; and $Cs_2ZrCl_6:Re^{4+}$), or a combination comprising one or both of the foregoing. The upshifting agent can comprise less than or equal to 5 weight percent (wt %) of the Ti, Os, or Re based on the total weight of the agent. The luminescent agent can comprise an organic dye (such as rhodamine 6G), an indacene dye (such as a polyazaindacene dye)), a quantum dot, a rare earth complex, a transition metal ion, or a combination comprising one or more of the foregoing. The luminescent agent can comprise a pyrrolopyrrole cyanine (PPCy) dye. The organic dye molecules can be attached to a polymer backbone or can be dispersed in the radiation emitting layer. The luminescent agent can comprise a pyrazine type compound having a substituted amino and/or cyano group, pteridine compounds such as benzopteridine derivatives, perylene type compounds (such as LUMOGEN™ 083 (commercially available from BASF, NC)), anthraquinone type compounds, thioindigo type compounds, naphthalene type compounds, xanthene type compounds, or a combination comprising one or more of the foregoing. The luminescent agent can comprise pyrrolopyrrole cyanine (PPCy), a bis(PPCy) dye, an acceptor-substituted squaraine, or a combination comprising one or more of the foregoing. The pyrrolopyrrole cyanine can comprise $BF_2$-PPCy, $BPh_2$-PPCy, bis($BF_2$-PPCy), bis($BPh_2$-PPCy), or a combination comprising one or more of the foregoing. The luminescent agent can comprise a lanthanide-based compound such as a lanthanide chelate. The luminescent agent can comprise a chalcogenide-bound lanthanide. The luminescent agent can comprise a transition metal ion such as $NaCl:Ti^{2+}$; $MgCl_2:Ti^{2+}$; or a combination comprising at least one of the foregoing. The luminescent agent can comprise $YAlO_3:Cr^{3+}$, $Yb^{3+}$; $Y_3Ga_5O_{12}:Cr^{3+},Yb^{3+}$; or a combination comprising at least one of the foregoing. The luminescent agent can comprise $Cs_2ZrBr_6:Os^{4+}$; $Cs_2ZrCl_6:Re^{4+}$; or a combination comprising at least one of the foregoing. The luminescent agent can comprise a combination comprising at least one of the foregoing luminescent agents.

The luminescent agent can have a molar extinction of greater than or equal to 100,000 inverse molar concentration times inverse centimeters ($M^{-1}$ $cm^{-1}$). The luminescent agent can have a molar extinction of greater than or equal to 500,000 $M^{-1}$ $cm^{-1}$.

The luminescent agent can be encapsulated in a surrounding sphere, such as a silica or polystyrene sphere, and the like. The luminescent agent can be free of one or more of lead, cadmium, and mercury. The luminescent agent can have a quantum yield of 0.1 to 0.95. The luminescent agent can have a quantum yield of 0.2 to 0.75.

The luminescent agent can absorb radiation over a first range of wavelengths and can emit radiation over a second range of wavelengths that can partially overlap with the first range. The radiation that can be absorbed by the luminescent agent can originate from the radiation source and/or from the same species of luminescent agent and/or from a different species of luminescent agent.

Emission from the luminescent agent can be directionally isotropic, where emitted photons either exit the device through an escape cone or are confined to the radiation emitting layer by total internal reflection. The direction of the radiation exiting through the escape cone can be uniformly distributed over a wide angular range centered on the direction perpendicular to the broad surfaces of the device.

Excitation and emission for the luminescent agent can be anisotropic (also referred to as dichroic) such that excitation and emission can be favored in directions perpendicular to a long axis of the luminescent agent. The long axis can be perpendicular to the broad surface, or at least within, for example, 10 degrees of normal. Alternatively, alignment of the long axis can vary at various locations. For example, the long axis of an anisotropic luminescent agent towards a center of one of the broad surfaces can be at an angle of, for example, 10 degrees to 90 degrees from the normal to the surface and the long axis of the anisotropic luminescent agent towards an edge of the heating device can be within 10degrees of normal with respect to the broad surface.

In addition to absorption of emitted radiation within the absorber layer, emitted radiation can be absorbed by water and/or ice on a surface of the device. The emitted radiation can have a wavelength ranging from that of UV radiation to near IR radiation. The emitted radiation can have a wavelength of 10 nm to 2.5 micrometers. Emissions in the UV and/or near IR wavelength range can be useful in applications such as defogging, defrosting, and deicing as water and ice have absorption coefficients that practically coincide over wavelengths ranging from the UV to near IR, exhibiting respective minima in the visible wavelength range and increasing rapidly away from these minima.

The absorber layer comprises an absorber and can further comprise a UV absorbing molecule. The absorber layer can comprise an absorber layer host material, where the absorber layer host material can be the same or different from the emitting layer host material. The absorber layer host material can comprise glass. The absorber layer host material can comprise polyvinyl butyral. Conversely, the absorber layer can be free of a host material. For example, the layered structure can comprise an emitting layer, a glass layer, and an absorber located there between, where the height of the absorber layer, $d_A$, would be the sum of the average diameter of the average number of absorbers spanning the height of the absorber layer. The absorber layer can have a lower refractive index than the radiation emitting layer.

The absorber layer can have a smooth first surface that is in direct contact with the radiation emitting layer and a second surface that can be smooth or rough. The absorber layer can have a first surface that is in direct contact with the radiation emitting layer and can conform to said surface of the radiation emitting layer; and the second surface that can be smooth or rough.

The absorber can comprise a radiationless absorber. The absorber can comprise any absorber with an absorption spectrum that overlaps with an emission spectrum of a luminescent agent in the radiation emitting layer. The absorber can be a compound with an absorption of 700 to 1500 nm. The absorber can comprise an organic absorber (such as phthalocynanine compounds and naphthalocyanines compounds), an inorganic absorber (such as an indium tin oxide (ITO) and an antimony tin oxide (ATO)), or a combination comprising one or both of the foregoing. The absorber can comprise a rare earth element (such as Sc, Y, La, Ce, Pr, Nd, Pm, Sm, Eu, Gd, Tb, Dy, Ho, Er, Tm, Yb and Lu), ITO, ATO, a phthalocynanine compound, a naphthalocyanine compound, an azo dye, an anthraquinone, a squaric acid derivative, an immonium dye, a perylene (such as LUMOGEN™ 083 (commercially available from BASF, NC)), a quaterylene, a polymethine, or a combination comprising one or more of the foregoing. The absorber can comprise one or both of a phthalocyanine and a naphthalocyanine, wherein one or both of the foregoing can have a barrier side group, for example, phenyl, phenoxy, alkylphenyl, alkylphenoxy, tert.-butyl, —S-phenyl-aryl, —NH-aryl, NH-alkyl, and the like. The absorber can comprise a Cu(II) phosphate compound, which can comprise one or both of methacryloyloxyethyl phosphate (MOEP) and copper(II) carbonate (CCB). The absorber can comprise a quaterrylenetetracarbonimide compound. The absorber can comprise a hexaboride represented by $XB_6$, wherein X is at least one selected from La, Ce, Pr, Nd, Gd, Tb, Dy, Ho, Y, Sm, Eu, Er, Tm, Yb, Lu, Sr, and Ca. The absorber can comprise a hexaboride and a particle comprising one or both of ITO and ATO, wherein the ratio of the hexaboride to the particle can be 0.1:99.0 to 15:85, and wherein the particle can have an average diameter of less than or equal to 200 nm. The absorber can comprise a combination comprising one or more of the foregoing absorbers. The absorber can be present in an amount of 0.1 to 20 parts by weight per 100 parts of the absorber layer.

It is noted that when two absorber layers are present, the two absorber layers can be the same or different, comprising the same or different host materials and the same or different absorbers.

The radiation source can be an edge mounted light source as is illustrated in FIG. 1. Likewise, the radiation source can be remote from the device and coupled to at least one edge of the device by, for example, an optical fiber. When a remote radiation source is used, the radiation source can be used in conjunction with one or more devices. The radiation source can couple with the entire height d of the layered structure or can couple with only the height of the emitting layer $d_L$.

The coupling of the radiation source to the heating device can be optically continuous and can be configured to emit radiation within the acceptance cone at the edge of the heating device so that the radiation can be guided through the device by total internal reflection. As used herein, the term "optically continuous" can mean that 90 to 100% of the light from the radiation source is transmitted into the heating device. The radiation source can be coupled to the edge the heating device having a surface as defined by a height, for example, a height d or a height $d_L$, and a width that is not illustrated in the FIG. 1.

The radiation source can be a radiation source that emits 40 to 400 Watts per meter as measured along the edge to which the source is coupled (W/m). The radiation source can be a radiation source that emits 70 to 300 W/m. The radiation source can be a radiation source that emits 85 to 200 W/m.

The radiation source can emit radiation with a wavelength of 100 to 2,500 nm. The radiation source can emit radiation with a wavelength of 300 to 1,500 nm. The radiation source can emit radiation in the visible range with a wavelength of 380 to 750 nm. The radiation source can emit near infrared radiation with a wavelength of 700 to 1,200 nm. The radiation source can emit near infrared radiation with a wavelength of 800 to 1,100 nm. The radiation source can emit UV radiation with a wavelength of 250 to 400 nm. The radiation source can emit UV radiation with a wavelength of 350 to 400 nm. The emitted radiation from the radiation source can be filtered to a desired wavelength before being introduced to the radiation emitting layer.

The radiation source can be, for example, a light-emitting diode (LED), a light bulb (such as a tungsten filament bulb); an ultraviolet light; a fluorescent lamp (such as one that emits white, pink, black, blue, or black light blue (BLB) light); an incandescent lamp; a high intensity discharge lamp (such as a metal halide lamp); a cold-cathode tube, fiber optical waveguides; organic light-emitting diodes (OLED); or devices generating electro-luminescence (EL).

The heating device can optionally have a mirror located on one or more sides of the device in order to increase the efficiency of the heating device by reflecting photons that otherwise might exit the device. The mirror can be highly reflective, such as in the near-IR range, and can be a metallization of a side. Specifically, the heating device can comprise one or more of an edge mirror, for example, a selectively reflecting edge mirror. The edge mirror can be located on an edge to redirect radiation that would have otherwise escaped from the device back into the radiation emitting layer. The selectively reflecting edge mirror can be located on an edge between the radiation source and the radiation emitting layer, such that the source spectrum is largely transmitted between the radiation source and the device while the emission spectra of the luminescent agent can be largely reflected back into the radiation emitting layer. When emission is desired from only the emitting layer second surface, a surface mirror can be located on the emitting layer first surface or can be located proximal to said surface such that there is a gap located there between. The gap can comprise a liquid (such as water, oil, a silicon fluid, or the like), a solid that has a lower refractive index than the radiation emitting layer, or a gas (such as air, oxygen, nitrogen, or the like). The gap can comprise a liquid or gas that has a lower RI than the radiation emitting layer. The gap can be an air gap to support total internal reflection within the device.

The heating device can comprise a protective coating layer on an external surface of the device. The heating device can comprise a protective coating layer on the emitting layer second surface, the absorbing layer first surface, the emitting layer first surface the absorbing layer second surface, or a combination comprising at least one of the foregoing. The heating device can comprise a protective coating layer, where the coating can be applied to one or both of the emitting layer first surface and an absorbing layer second surface. The protective coating layer can comprise a UV protective layer, an abrasion resistant layer, an anti-fog layer, or a combination comprising one or more of the foregoing. The protective coating layer can comprise a silicone hardcoat.

A UV protective layer can be applied to an external surface of the device. For example, the UV protective layer can be a coating having a thickness of less than or equal to 100 micrometers (μm). The UV protective layer can be a coating having a thickness of 4 μm to 65 μm. The UV protective layer can be applied by various means, including dipping the plastic substrate in a coating solution at room temperature and atmospheric pressure (i.e., dip coating). The UV protective layer can also be applied by other methods including, but not limited to, flow coating, curtain coating, and spray coating. The UV protective layer can include silicones (e.g., a silicone hard coat), polyurethanes (e.g., polyurethane acrylate), acrylics, polyacrylate (e.g., polymethacrylate, polymethylmethacrylate), polyvinylidene fluoride, polyesters, epoxies, and combinations comprising at least one of the foregoing. The UV protective layer can comprise a UV blocking polymer, such as poly(methyl methacrylate), polyurethane, or a combination comprising one or both of the foregoing. The UV protective layer can comprise a UV absorbing molecule. The UV protective layer can include a silicone hard coat layer (for example, AS4000, AS4700, or PHC587, commercially available from Momentive Performance Materials).

The UV absorbing molecule can comprise a hydroxybenzophenone (e.g., 2-hydroxy-4-n-octoxy benzophenone), a hydroxybenzotriazine, a cyanoacrylate, an oxanilide, a benzoxazinone (e.g., 2,2'-(1,4-phenylene)bis(4H-3,1-benzoxazin-4-one, commercially available under the trade name CYASORB UV-3638 from Cytec), an aryl salicylate, a hydroxybenzotriazole (e.g., 2-(2-hydroxy-5-methylphenyl) benzotriazole, 2-(2-hydroxy-5-tert-octylphenyl)benzotriazole, and 2-(2H-benzotriazol-2-yl)-4-(1,1,3,3-tetramethylbutyl)-phenol, commercially available under the trade name CYASORB 5411 from Cytec), or a combination comprising at least one of the foregoing. The UV absorbing molecule can comprise a hydroxyphenylthazine, a hydroxybenzophenone, a hydroxylphenylbenzothazole, a hydroxyphenyltriazine, a polyaroylresorcinol, a cyanoacrylate, or a combination comprising at least one of the foregoing. The UV absorbing molecule can be present in an amount of 0.01 to 1 wt %, specifically, 0.1 to 0.5 wt %, and more specifically, 0.15 to 0.4 wt %, based upon the total weight of polymer in the composition.

The UV protective layer can include a primer layer and a coating (e.g., a top coat). A primer layer can aid in adhesion of the UV protective layer to the device. The primer layer can include, but is not limited to, acrylics, polyesters, epoxies, and combinations comprising at least one of the foregoing. The primer layer can also include ultraviolet absorbers in addition to or in place of those in the top coat of the UV protective layer. For example, the primer layer can include an acrylic primer (for example, SHP401 or SHP470, commercially available from Momentive Performance Materials).

An abrasion resistant layer (e.g., a coating or plasma coating) can be applied to one or more surfaces of the device. For example, an abrasion resistant layer can be located proximal one or both of an absorber layer second surface and the emitting layer first surface, where each abrasion resistant layer independently can be in direct contact with one of the aforementioned surfaces or a second protective layer such as a UV protective layer can be located in between. The abrasion resistant layer can include a single layer or a multitude of layers and can add enhanced functionality by improving abrasion resistance of the heating device. Generally, the abrasion resistant layer can include an organic coating and/or an inorganic coating such as, but not limited to, aluminum oxide, barium fluoride, boron nitride, hafnium oxide, lanthanum fluoride, magnesium fluoride, magnesium oxide, scandium oxide, silicon monoxide, silicon dioxide, silicon nitride, silicon oxy-nitride, silicon carbide, silicon oxy carbide, hydrogenated silicon oxy-carbide, tantalum oxide, titanium oxide, tin oxide, indium tin oxide, yttrium oxide, zinc oxide, zinc selenide, zinc sulfide, zirconium oxide, zirconium titanate, glass, and combinations comprising at least one of the foregoing.

The abrasion resistant layer can be applied by various deposition techniques such as vacuum assisted deposition processes and atmospheric coating processes. For example, vacuum assisted deposition processes can include, but are not limited to, plasma enhanced chemical vapor deposition (PECVD), arc-PECVD, expanding thermal plasma PECVD, ion assisted plasma deposition, magnetron sputtering, electron beam evaporation, and ion beam sputtering.

Optionally, one or more of the layers (e.g., UV protective layer and/or abrasion resistant layer and/or an anti-fog layer) can be a film applied to an external surface of the heating device by a method such as lamination or film insert molding. In this case, the functional layer(s) or coating(s) could be applied to the film and/or to the side of the heating device opposite the side with the film. For example, a co-extruded film, an extrusion coated, a roller-coated, or an extrusion-laminated film comprising greater than one layer can be used as an alternative to a hard coat (e.g., a silicone hard coat) as previously described. The film can contain an additive or copolymer to promote adhesion of the UV protective layer (i.e., the film) to an abrasion resistant layer, and/or can itself include a weatherable material such as an acrylic (e.g., polymethylmethacrylates), fluoropolymer (e.g., polyvinylidene fluoride, polyvinyl fluoride), etc., and/or can block transmission of ultraviolet radiation sufficiently to protect the underlying substrate; and/or can be suitable for film insert molding (FIM) (in-mold decoration (IMD)), extrusion, or lamination processing of a three dimensional shaped panel.

One or more of the layers can each independently include an additive. The additive can include colorant(s), antioxidant(s), surfactant(s), plasticizer(s), infrared radiation absorber(s), antistatic agent(s), antibacterial(s), flow additive(s), dispersant(s), compatibilizer(s), cure catalyst(s), UV absorbing molecule(s), and combinations comprising at least one of the foregoing. The type and amounts of any additives added to the various layers depends on the desired performance and end use of the enclosure.

The UV absorbing molecule can include hydroxybenzophenones (e.g., 2-hydroxy-4-n-octoxy benzophenone), hydroxybenzotriazines, cyanoacrylates, oxanilides, benzoxazinones (e.g., 2,2'-(1,4-phenylene)bis(4H-3,1-benzoxazin-4-one, commercially available under the trade name CYASORB UV-3638 from Cytec), aryl salicylates, hydroxybenzotriazoles (e.g., 2-(2-hydroxy-5-methylphenyl) benzotriazole, 2-(2-hydroxy-5-tert-octylphenyl)benzotriazole, and 2-(2H-benzotriazol-2-yl)-4-(1,1,3,3-tetramethylbutyl)-phenol, commercially available under the trade name CYASORB 5411 from Cytec) or combinations comprising at least one of the foregoing UV stabilizers. The UV stabilizers can be present in an amount of 0.01 to 1 wt %, specifically, 0.1 to 0.5 wt %, and more specifically, 0.15 to 0.4 wt %, based upon the total weight of polymer in the composition.

The protective coating(s) can be selected such that it does not absorb in the near-IR range.

The protective coating layer can have a lower refractive index than the radiation emitting layer. The protective coating layer can have a lower refractive index than the radiation emitting layer and the absorber layer. The protective coating can have a refractive index that is lower than that of the emitting layer host material.

The heating device can be a flat panel, a glazing, or a lens for lighting modules. The heating device can be used for one or more of defogging, defrosting, and deicing, specifically in applications such as exterior lighting, for example, automotive exterior lighting (headlights and tail lights), air field lights, street lights, traffic lights, and signal lights; glazings, for example, for transportation (automotive) or construction applications (skylights); appliances, for example, for defrosting a refrigerator door, a freezer door, an interior wall of a freezer and/or a refrigerator compartment; or for signage. Such a heating device allows for one or more of defogging, defrosting, and deicing to be accomplished without the use of resistively-heated conductors.

The heating device can be used for heated surfaces such as mirrors (such as mirrors located in a bathroom, a fitness facility, a pool facility, and a locker room), floors, doors (such as refrigerator doors and freezer door), shelves, countertops, and the like. When the heated surface is a mirror, the mirror can be "silvered" on a surface of a layer other than the radiation emitting layer.

Set forth below are some embodiments of the present device for heating a surface and method of heating a surface.

Embodiment 1: A heating device comprising: a radiation source that emits a source radiation, a radiation emitting layer comprising an emitting layer host material and a luminescent agent, wherein the radiation emitting layer comprises an edge, an emitting layer first surface, and an emitting layer second surface; wherein the edge has a height of $d_L$ and the emitting layer first surface has a length L, wherein length L is greater than height $d_L$, and the ratio of the length L to the height $d_L$ is greater than or equal to 10; wherein the radiation source is coupled to the edge, wherein the source radiation is transmitted from the radiation source through the edge and excites the luminescent agent, whereafter the luminescent agent emits an emitted radiation, wherein at least a portion of the emitted radiation exits through the emitting layer second surface through an escape cone; an absorber layer, wherein the absorber layer comprises an absorber layer first surface and wherein the absorber layer first surface is in direct contact with the emitting layer second surface, wherein the absorber layer comprises an absorber that absorbs emitted radiation that escapes through the escape cone.

Embodiment 2: The device of Embodiment 1, wherein the radiation emitted from one or both of the emitting layer first surface and the emitting layer second surface is uniform such that the measured radiation at all locations on emitting layer first surface and the emitting layer second surface is within 40%, specifically, specifically, 30%, more specifically, 20% of the average radiation being emitted from the respective surfaces.

Embodiment 3: The device of any of the preceding Embodiments, wherein the radiation emitted is capable of melting a 1mm thick layer of ice located on an absorber layer second surface in less than or equal to 1 hour.

Embodiment 4: The device of any of the preceding Embodiments, wherein the ratio of the length L to the height $d_L$ is greater than or equal to 30.

Embodiment 5: The device of any of the preceding Embodiments, wherein the absorber does not emit light.

Embodiment 6: The device of any of the preceding Embodiments, wherein the absorber layer is free of an absorber layer host material.

Embodiment 7: The device of any of Embodiments 1-5, wherein the absorber layer comprises an absorber layer host material.

Embodiment 8: The device of any of the preceding Embodiments, wherein one or both of the emitting layer host material and the absorber layer host material comprises polycarbonate, polyester, polyacrylate, polyvinyl butyral, polyisoprene, or a combination comprising one or more of the foregoing.

Embodiment 9: The device of Embodiment 8, wherein the polyester comprises polyethylene terephthalate and the polyacrylate comprises a polyalkylmethacrylate such as polymethylmethacrylate.

Embodiment 10: The device of any of the preceding Embodiments, wherein the radiation emitting layer has a higher refractive index than the absorber layer.

Embodiment 11: The device of any of the preceding Embodiments, wherein the absorber comprises an organic compound, an inorganic compound, or a combination comprising one or both of the foregoing.

Embodiment 12: The device of any of the preceding Embodiments, wherein the absorber comprises a rare earth element (such as Sc, Y, La, Ce, Pr, Nd, Pm, Sm, Eu, Gd, Tb, Dy, Ho, Er, Tm, Yb and Lu), ITO, ATO, a phthalocynanine compound, a naphthalocyanine compound, an azo dye, an anthraquinone, a squaric acid derivative, an immonium dye, a perylene, a quaterylene, a polymethine, or a combination comprising one or more of the foregoing.

Embodiment 13: The device of any of the preceding Embodiments, wherein the absorber comprises absorber comprises one or both of a phthalocyanine and a naphthalocyanine, wherein one or both of the foregoing can have a barrier side group, for example, phenyl, phenoxy, alkylphenyl, alkylphenoxy, tert.-butyl, —S-phenyl-aryl, —NH-aryl, NH-alkyl, and the like.

Embodiment 14: The device of any of the preceding Embodiments, wherein the absorber comprises one or both of a quaterrylenetetracarbonimide compound and a Cu(II) phosphate compound, which can comprise one or both of methacryloyloxyethyl phosphate (MOEP) and copper(II) carbonate (CCB).

Embodiment 15: The device of any of the preceding Embodiments, wherein the absorber comprises a hexaboride represented by $XB_6$, wherein X is at least one selected from La, Ce, Pr, Nd, Gd, Tb, Dy, Ho, Y, Sm, Eu, Er, Tm, Yb, Lu, Sr, and Ca and optionally a particle comprising one or both of ITO and ATO, wherein the ratio of the hexaboride to the particle is 0.1:99.0 to 15:85, and wherein the particle can have an average diameter of less than or equal to 200 nm.

Embodiment 16: The device of any of the preceding Embodiments, wherein the luminescent agent comprises a dye, a quantum dot, a rare earth complex, a transition metal ion, or a combination comprising one or more of the foregoing.

Embodiment 17: The device of any of the preceding Embodiments, wherein the emitted radiation comprises radiation with a wavelength in the UV range, the visible range, the near IR range, or a combination comprising one or more of the foregoing.

Embodiment 18: The device of Embodiment 17, wherein the emitted radiation comprises radiation with a wavelength in the near IR range.

Embodiment 19: The device of any of the preceding Embodiments, wherein the luminescent agent has an average particle size, measured on a major axis, of less than or equal to 40 nm.

Embodiment 20: The device of any of the preceding Embodiments, wherein the luminescent agent does not scatter visible light.

Embodiment 21: The device of any of the preceding Embodiments, further comprising a sensor for detecting the presence of water or ice.

Embodiment 22: The device of any of the preceding Embodiments, further comprising a switch configured to turn the radiation source on and off.

Embodiment 23: The device of any of the preceding Embodiments, further comprising one or more of an edge mirror, a selectively reflecting edge mirror, and a surface mirror.

Embodiment 24: The device of any of the preceding Embodiments, wherein one or both of the radiation emitting layer and the absorber layer comprises an in-mold coating layer.

Embodiment 25: The device of any of the preceding Embodiments, further comprising a protective coating, wherein the protective coating comprises a UV protective layer, an abrasion resistant layer, an anti-fog layer, or a combination comprising one or more of the foregoing.

Embodiment 26: The device of any of the preceding Embodiments, wherein the luminescent agent comprises $(py)_{24}Nd_{28}F_{68}(SePh)_{16}$;NaCl:$Ti^{2+}$; $MgCl_2$:$Ti^{2+}$; $Cs_2ZrBr_6$:$Os^{4+}$; $Cs_2ZrCl_6$:$Re^{4+}$; $YAlO_3$:$Cr^{3+}$,$Yb^{3+}$; $Y_3Ga_5O_{12}$:$Cr^{3+}$ $Yb^{3+}$; rhodamine 6G; an indacene dye; a pyrazine type compound having one or both of a substituted amino group and a cyano group; a pteridine compound; a perylene type compound; an anthraquinone type compound; a thioindigo type compound; a naphthalene type compound; a xanthene type compound; a pyrrolopyrrole cyanine (PPCy); a bis (PPCy) dye; an acceptor-substituted squaraine; a lanthanide-based compound; or a combination comprising one or more of the foregoing.

Embodiment 27: The device of any of the preceding Embodiments, wherein the luminescent agent comprises $(py)_{24}Nd_{28}F_{68}(SePh)_{16}$; NaCl: $Ti^{2+}$; $MgCl_2$:$Ti^{2+}$; $Cs_2ZrBr_6$:$Os^{4+}$; $Cs_2ZrCl_6$:$Re^{4+}$; $YAlO_3$:$Cr^{3+}Yb^{3+}$; $Y_3Ga_5O_{12}$:$Cr^{3+}$ $Yb^{3+}$; or a combination comprising one or more of the foregoing.

Embodiment 28: A method for heating an absorber layer second surface utilizing any of the devices of the preceding embodiments and comprising: emitting the source radiation from the radiation source; illuminating the radiation emitting layer comprising the emitting layer host material and the luminescent agent with the radiation, wherein the radiation emitting layer comprises the edge, the emitting layer first surface, and the emitting layer second surface; wherein the radiation source is coupled to the edge, wherein the source radiation is transmitted from the radiation source through the edge and excites the luminescent agent, whereafter the luminescent agent emits the emitted radiation, wherein at least a portion of the emitted radiation exits through the emitting layer second surface through an escape cone; absorbing the emitted radiation by an absorber in an absorber layer that comprises an absorber layer first surface and the absorber layer second surface and wherein the absorber layer first surface is in direct contact with the emitting layer second surface; heating the absorber layer second surface.

Embodiment 29: The method of Embodiment 28, further comprising sensing the presence of ice and/or water on the absorber layer second surface.

Embodiment 30: The method of Embodiment 29, further comprising switching the radiation source on when water and/or ice is sensed on the absorber layer second surface and switching the radiation source off when the absorber layer second surface is free of water and/or ice.

In general, the invention may alternately comprise, consist of, or consist essentially of, any appropriate components herein disclosed. The invention may additionally, or alternatively, be formulated so as to be devoid, or substantially free, of any components, materials, ingredients, adjuvants or species used in the prior art compositions or that are otherwise not necessary to the achievement of the function and/or objectives of the present invention.

All ranges disclosed herein are inclusive of the endpoints, and the endpoints are independently combinable with each other (e.g., ranges of "up to 25 wt %, or, more specifically, 5 wt % to 20 wt %," is inclusive of the endpoints and all intermediate values of the ranges of "5 wt % to 25 wt %," etc.). "Combination" is inclusive of blends, mixtures, alloys, reaction products, and the like. Furthermore, the terms "first," "second," and the like, herein do not denote any order, quantity, or importance, but rather are used to denote one element from another. The terms "a" and "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment," "another embodiment," "an embodiment," and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

While particular embodiments have been described, alternatives, modifications, variations, improvements, and substantial equivalents that are or may be presently unforeseen may arise to Applicants or others skilled in the art. Accordingly, the appended claims as filed and as they may be amended are intended to embrace all such alternatives, modifications variations, improvements, and substantial equivalents.

This application claims the benefit of U.S. Provisional Patent Application Ser. No. 62/084,071 filed Nov. 25, 2014. The related application is incorporated herein by reference.

I claim:

1. A heating device comprising:

a radiation source that emits a source radiation, a radiation emitting layer comprising an emitting layer host material and a luminescent agent, wherein the radiation emitting layer comprises an edge, an emitting layer first surface, and an emitting layer second surface; wherein the edge has a height of $d_L$ and the emitting layer first surface has a length L, wherein length L is greater than height $d_L$, and the ratio of the length L to the height $d_L$ is greater than or equal to 10;

wherein the radiation source is coupled to the edge, wherein the source radiation is transmitted from the radiation source through the edge and excites the luminescent agent, whereafter the luminescent agent emits an emitted radiation, wherein at least a portion of the emitted radiation exits through the emitting layer second surface through an escape cone;

an absorber layer, wherein the absorber layer comprises an absorber layer first surface and wherein the absorber layer first surface is in direct contact with the emitting layer second surface, wherein the absorber layer comprises an absorber that absorbs emitted radiation that escapes through the escape cone.

2. The device of claim 1, wherein the radiation emitted from one or both of the emitting layer first surface and the emitting layer second surface is uniform such that the measured radiation at all locations on the emitting layer first surface and the emitting layer second surface is within 40% of the average radiation being emitted from the respective surfaces.

3. The device of any of the preceding claims, wherein the radiation emitted is capable of melting a 1 mm thick layer of ice located on an absorber layer second surface in less than or equal to 1 hour.

4. The device of any of the preceding claims, wherein the ratio of the length L to the height $d_L$ is greater than or equal to 30.

5. The device of any of the preceding claims, wherein the absorber does not emit light.

6. The device of any of the preceding claims, wherein the absorber layer comprises an absorber layer host material.

7. The device of any of the preceding claims, wherein one or both of the emitting layer host material and the absorber layer host material comprises polycarbonate, polyester, polyacrylate, polyvinyl butyral, polyisoprene, a polyimide, or a combination comprising one or more of the foregoing.

8. The device of claim 7, wherein the polyester comprises polyethylene terephthalate and the polyacrylate comprises polymethylmethacrylate.

9. The device of any of the preceding claims, wherein the radiation emitting layer has a higher refractive index than the absorber layer.

10. The device of any of the preceding claims, wherein the absorber comprises an organic compound, an inorganic compound, or a combination comprising one or both of the foregoing.

11. The device of any of the preceding claims, wherein the luminescent agent comprises a dye, a quantum dot, a rare earth complex, a transition metal ion, or a combination comprising one or more of the foregoing.

12. The device of any of the preceding claims, wherein the emitted radiation comprises radiation with a wavelength in the UV range, the visible range, the near IR range, or a combination comprising one or more of the foregoing.

13. The device of any of the preceding claims, wherein the luminescent agent has an average particle size, measured on a major axis, of less than or equal to 40 nm.

14. The device of any of the preceding claims, wherein the luminescent agent does not scatter visible light.

15. The device of any of the preceding claims, further comprising a sensor for detecting the presence of water or ice.

16. The device of any of the preceding claims, further comprising a switch configured to turn the radiation source on and off.

17. The device of any preceding claims, wherein the luminescent agent comprises $(py)_{24}Nd_{28}F_{68}(SePh)_{16}$; NaCl:$Ti^{2+}$; $MgCl_2$:$Ti^{2+}$; $Cs_2ZrBr_6$:$Os^{4+}$; $Cs_2ZrCl_6$:$Re^{4+}$; $YAlO_3$:$Cr^{3+}$,$Yb^{3+}$; $Y_3Ga_5O_{12}$:$Cr^{3+}$,$Yb^{3+}$; rhodamine 6G; an indacene dye; a pyrazine type compound having one or both of a substituted amino group and a cyano group; a pteridine compound; a perylene type compound; an anthraquinone type compound; a thioindigo type compound; a naphthalene type compound; a xanthene type compound; a pyrrolopyrrole cyanine (PPCy); a bis(PPCy) dye; an acceptor-substituted squaraine; a lanthanide-based compound; or a combination comprising one or more of the foregoing.

18. A method for heating an absorber layer second surface comprising:

emitting a source radiation from a radiation source;

illuminating a radiation emitting layer comprising an emitting layer host material and a luminescent agent with the radiation, wherein the radiation emitting layer comprises an edge, an emitting layer first surface, and an emitting layer second surface;

wherein the radiation source is coupled to the edge, wherein the source radiation is transmitted from the radiation source through the edge and excites the luminescent agent, whereafter the luminescent agent emits an emitted radiation, wherein at least a portion of the emitted radiation exits through the emitting layer second surface through an escape cone;

absorbing the emitted radiation by an absorber in an absorber layer that comprises an absorber layer first surface and the absorber layer second surface and wherein the absorber layer first surface is in direct contact with the emitting layer second surface;

heating the absorber layer second surface.

19. The method of claim 18, further comprising sensing the presence of ice and/or water on the absorber layer second surface.

20. The method of claim 19, further comprising switching the radiation source on when water and/or ice is sensed on the absorber layer second surface and switching the radiation source off when the absorber layer second surface is free of water and/or ice.

* * * * *